US009908175B2

(12) United States Patent
Bullied et al.

(10) Patent No.: US 9,908,175 B2
(45) Date of Patent: Mar. 6, 2018

(54) DIE CASTING SYSTEM AND METHOD UTILIZING SACRIFICIAL CORE

(71) Applicant: UNITED TECHNOLOGIES CORPORATION, Hartford, CT (US)

(72) Inventors: Steven J. Bullied, Pomfret Center, CT (US); John Joseph Marcin, Marlborough, CT (US); Dorothea C. Wong, South Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 330 days.

(21) Appl. No.: 14/449,248

(22) Filed: Aug. 1, 2014

(65) Prior Publication Data

US 2014/0338854 A1 Nov. 20, 2014

Related U.S. Application Data

(62) Division of application No. 12/940,077, filed on Nov. 5, 2010, now Pat. No. 8,807,198.

(51) Int. Cl.

| | |
|---|---|
| ***B22D 17/14*** | (2006.01) |
| ***B22D 17/20*** | (2006.01) |
| ***B22D 17/24*** | (2006.01) |
| ***B22D 29/00*** | (2006.01) |
| ***B22D 17/10*** | (2006.01) |

(52) U.S. Cl.

CPC ..... *B22D 17/20* (2013.01); *B22D 17/10* (2013.01); *B22D 17/14* (2013.01); *B22D 17/203* (2013.01); *B22D 17/24* (2013.01); *B22D 29/002* (2013.01); *Y10T 29/4981* (2015.01)

(58) Field of Classification Search

CPC ..... B22D 17/10; B22D 17/14; B22D 17/20; B22D 17/203; B22D 17/24; B22D 29/00; B22D 29/002

USPC ..... 164/253, 284, 302, 312

See application file for complete search history.

(56) References Cited

U.S. PATENT DOCUMENTS 4,352,390 A * 10/1982 Larson ..... B22C 1/00 164/351
5,178,202 A 1/1993 Dannoura et al.
6,021,840 A 2/2000 Colvin
(Continued)

FOREIGN PATENT DOCUMENTS

EP 0465947 A1 6/1991
EP 0901853 A1 3/1999
(Continued)

OTHER PUBLICATIONS

Singapore Search and Examination Report for Singapore Application No. 201108142-9 dated Oct. 30, 2013.
(Continued)

*Primary Examiner* — Kevin P Kerns
(74) *Attorney, Agent, or Firm* — Carlson, Gaskey & Olds

(57) ABSTRACT

A method for die casting a component includes inserting at least one sacrificial core into a die cavity of a die comprised of a plurality of die elements. Molten metal is injected into the die cavity. The molten metal is solidified within the die cavity to form the component. The plurality of die elements are disassembled from the component, and the at least one sacrificial core is destructively removed from the component.

23 Claims, 2 Drawing Sheets

(56) References Cited

U.S. PATENT DOCUMENTS

| | | | | |
|---|---|---|---|---|
| 6,068,806 | A | 5/2000 | Dietrich | |
| 6,070,643 | A | 6/2000 | Colvin | |
| 6,340,047 | B1 | 1/2002 | Frey | |
| 6,637,500 | B2 | 10/2003 | Shah et al. | |
| 6,913,064 | B2 | 7/2005 | Beals et al. | |
| 6,929,054 | B2 | 8/2005 | Beals et al. | |
| 8,807,198 | B2 * | 8/2014 | Bullied et al. | B22D 17/10 164/113 |
| 2003/0075300 | A1 | 4/2003 | Shah et al. | |
| 2007/0044933 | A1 | 3/2007 | Santeler | |
| 2007/0137827 | A1 * | 6/2007 | Vogt et al. | B22C 9/04 164/113 |
| 2008/0145235 | A1 | 6/2008 | Cunha et al. | |
| 2010/0014102 | A1 | 1/2010 | Blair | |
| 2010/0129217 | A1 | 5/2010 | Cherolis et al. | |
| 2012/0186768 | A1 * | 7/2012 | Sun et al. | B22C 7/02 164/23 |

FOREIGN PATENT DOCUMENTS

| | | | |
|---|---|---|---|
| JP | 2002028751 | A | 1/2002 |
| JP | 2005334909 | A | 12/2005 |

OTHER PUBLICATIONS

Hungarian Written Opinion and Search Report for Application No. 201108142-9 dated Jun. 8, 2012.
Partial European Search Report for Application No. EP 11 18 7859 dated Dec. 1, 2015.
Extended European Search Report for Application No. EP 11 18 7859 dated Apr. 25, 2016.

* cited by examiner

DIE CASTING SYSTEM AND METHOD UTILIZING SACRIFICIAL CORE

CROSS-REFERENCED TO RELATED APPLICATIONS

This application is a divisional of U.S. patent application Ser. No. 12/940,077, which was filed on Nov. 5, 2010, now U.S. Pat. No. 8,807,198.

BACKGROUND

This disclosure relates generally to casting, and more particularly to die casting system utilizing a sacrificial core.

Die casting involves injecting molten metal directly into a reusable die to yield a net-shaped component. Die casting has typically been used to produce components that do not require high thermal mechanical performance. For example, die casting is commonly used to produce components made from relatively low melting temperature materials that are not exposed to extreme temperatures.

Gas turbine engines include multiple components that are subjected to extreme temperatures during operation. For example, the compressor section and turbine section of the gas turbine engine each include blades and vanes that are subjected to relatively extreme temperatures, such as temperatures exceeding approximately 1500° F./815° C. Typically, gas turbine engine components of this type are investment cast. Investment casting involves pouring molten metal into a ceramic shell having a cavity in the shape of the component to be cast. The investment casting process is labor intensive, time consuming and expensive.

SUMMARY

A method for die casting a component includes inserting at least one sacrificial core into a die cavity of a die comprised of a plurality of die elements. Molten metal is injected into the die cavity. The molten metal is solidified within the die cavity to form the component. The plurality of die elements are disassembled from the component, and the at least one sacrificial core is destructively removed from the component.

In another exemplary embodiment, a method for replacing a baseline component with an equiaxed component includes determining a cooling scheme required for replacing the baseline component with the equiaxed component. The baseline component is comprised of one of a single crystal advanced alloy component and a directionally solidified alloy component. A sacrificial core is configured to provide the equiaxed component with an internal geometry that provides the cooling scheme. The equiaxed component is die cast with the internal geometry using the sacrificial core. The baseline component is replaced with the equiaxed component.

In yet another exemplary embodiment, a die casting system includes a die comprised of a plurality of die components that define a die cavity, a sacrificial core received within the cavity, a shot tube and a shot tube plunger. The shot tube is in fluid communication with the die cavity. The shot tube plunger is moveable within the shot tube to communicate a molten metal into the die cavity.

The various features and advantages of this disclosure will become apparent to those skilled in the art from the following detailed description. The drawings that accompany the detailed description can be briefly described as follows.

DETAILED DESCRIPTION

Figure 1:
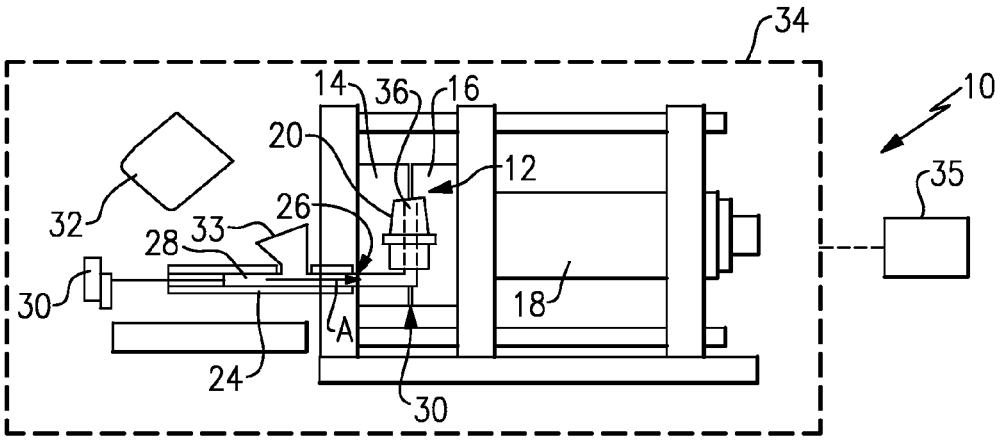
FIG. 1 illustrates an example die casting system.
Figure 4:
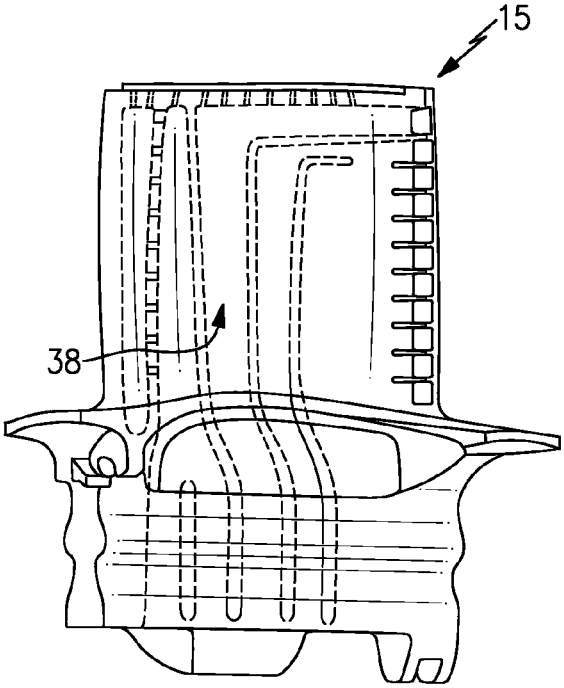
FIG. 4 illustrates an example component cast with a die casting system.

FIG. 1 illustrates a die casting system 10 including a reusable die 12 having a plurality of die elements 14, 16 that function to cast a component 15 (such as the component 15 depicted in FIG. 4, for example). Although two die elements 14, 16 are depicted in FIG. 1, it should be understood that the die 12 could include more or fewer die elements, as well as other parts and configurations.

The die 12 is assembled by positioning the die elements 14, 16 together and holding the die elements 14, 16 at a desired positioning via a mechanism 18. The mechanism 18 could include a clamping mechanism of appropriate hydraulic, pneumatic, electromechanical and/or other configurations. The mechanism 18 also separates the die elements 14, 16 subsequent to casting.

The die elements 14, 16 define internal surfaces that cooperate to define a die cavity 20. A shot tube 24 is in fluid communication with the die cavity 20 via one or more ports 26 located in the die element 14, the die element 16, or both. A shot tube plunger 28 is received within the shot tube 24 and is moveable between a retracted and injection position (in the direction of arrow A) within the shot tube 24 by a mechanism 30. The mechanism 30 could include a hydraulic assembly or other suitable mechanism, including, but not limited to, hydraulic, pneumatic, electromechanical, or any combination thereof.

The shot tube 24 is positioned to receive a molten metal from a melting unit 32, such as a crucible, for example. The melting unit 32 may utilize any known technique for melting an ingot of metallic material to prepare a molten metal for delivery to the shot tube 24, including but not limited to, vacuum induction melting, electron beam melting and induction skull melting. The molten metal is melted by the melting unit 32 at a location that is separate from the shot tube 24 and the die 12. In this example, the melting unit 32 is positioned in close proximity to the shot tube 24 to reduce the required transfer distance between the molten metal and the shot tube 24.

Example molten metals capable of being used to die cast a component 15 include, but are not limited to, nickel based super alloys, titanium alloys, high temperature aluminum alloys, copper based alloys, iron alloys, molybdenum, tungsten, niobium, or other refractory metals. This disclosure is not limited to the disclosed alloys, and it should be understood that any high melting temperature material may be utilized to die cast the component 15. As used herein, the term "high melting temperature material" is intended to include materials having a melting temperature of approximately 1500° F./815° C. and higher.

The molten metal is transferred from the melting unit 32 to the shot tube 24 in a known manner, such as pouring the molten metal into a pour hole 33 in the shot tube 24, for example. A sufficient amount of molten metal is poured into the shot tube 24 to fill the die cavity 20. The shot tube plunger 28 is actuated to inject the molten metal under pressure from the shot tube 24 into the die cavity 20 to cast the component 15. Although the casting of a single component is depicted, the die casting system 10 could be configured to cast multiple components in a single shot.

Although not necessary, at least a portion of the die casting system 10 may be positioned within a vacuum chamber 34 that includes a vacuum source 35. A vacuum is applied in the vacuum chamber 34 via the vacuum source 35 to render a vacuum die casting process. The vacuum chamber 34 provides a non-reactive environment for the die casting system 10 that reduces reaction, contamination, or other conditions that could detrimentally affect the quality of the cast component, such as excess porosity of the die cast component that can occur as a result of exposure to air. In one example, the vacuum chamber 34 is maintained at a pressure between $1\times10^{-3}$ Torr and $1\times10^{-4}$ Torr, although other pressures are contemplated. The actual pressure of the vacuum chamber 34 will vary based upon the type of component 15 being cast, among other conditions and factors. In the illustrated example, each of the melting unit 32, the shot tube 24 and the die 12 are positioned within the vacuum chamber 34 during the die casting process such that the melting, injecting and solidifying of the metal are all performed under vacuum.

The example die casting system 10 depicted in FIG. 1 is illustrative only and could include more or less sections, parts and/or components. This disclosure extends to all forms of die casting, including but not limited to, horizontal, inclined or vertical die casting systems.

At least one sacrificial core 36 may be received within the die cavity 20 to produce an internal geometry within the component 15. In one example, the sacrificial core 36 is preassembled to one (or both) of the die elements 14, 16 before the die elements 14, 16 are positioned relative to one another. In another example, the die elements 14, 16 and the sacrificial core 36 are assembled simultaneously. One or more portions of the sacrificial core 36 may be captured and retained in position by associated surfaces of one or more of the die elements 14, 16. For example, one or more perimeter portions of the sacrificial core 36 may be captured in associated compartments of the die cavity 20 so as to fall outside the ultimately cast component. A person of ordinary skill in the art having the benefit of this disclosure would be able to affix the sacrificial core 36 within the die cavity 20. The configuration of each sacrificial core 36 within the die cavity 20 is design dependent on numerous factors including, but not limited to, the type of component 15 to be cast.

In one example, the die elements 14, 16 of the die 12 are pre-heated subsequent to insertion of the sacrificial core 36 into the die 12. For example, the die 12 may be pre-heated between approximately 800° F./426° C. and approximately 1000° F./538° C. subsequent to insertion of the sacrificial core 36 and before injection of the molten metal. Among other benefits, pre-heating the die elements 14, 16 reduces thermal mechanical fatigue experience by these components during the injection of the molten metal.

Figure 2:
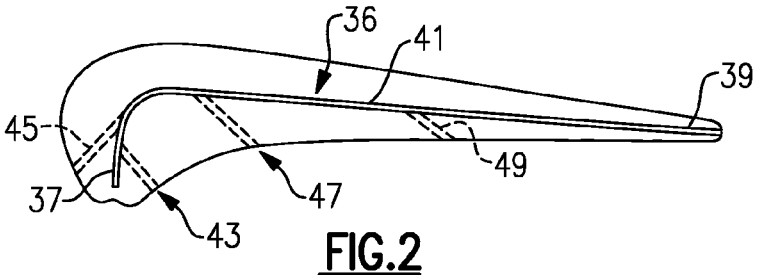
FIG. 2 illustrates a sacrificial core for use with a die casting system.

FIG. 2 illustrates one example sacrificial core 36. In this example, the sacrificial core 36 is a refractory metal core. The refractory metal core includes a refractory metal alloy such as MO, NB, TA, W, or other suitable refractory metal or mixture thereof, and optionally, a protective coating. Example refractory metal cores may include at least 50% or more by weight of one or more refractory metals. In another example, the sacrificial core 36 includes a ceramic core. In yet another example, the sacrificial core 36 could include a hybrid core including a ceramic mated to a refractory metal core.

Suitable protective coating materials for the sacrificial core 36 could include, but are not limited to, silica, alumina, zirconia, chromia, mullite and hafnia. These materials are not intended to be an exhaustive list of coatings. A coating is not necessary in all applications.

The sacrificial core 36 is shaped and positioned within the die cavity 20 to form a desired internal geometry within a component 15. For example, where the component 15 is to be implemented within a gas turbine engine, the sacrificial core 36 may be shaped and positioned within the die cavity 20 to form internal cooling schemes of a gas turbine engine turbine blade, such as microcircuit cooling schemes similar to those described in greater detail below.

In the illustrated example, the sacrificial core 36 is formed from a metal sheet of refractory metal. The example sacrificial core 36 has a leading edge portion 37, a trailing edge portion 39, and a central portion 41 extending between the leading edge portion 37 and the trailing edge portion 39. The sacrificial core 36 may have a plurality of bent portions 43 and 45 in the vicinity of the leading edge portion 37. The bent portions 43 and 45 form film cooling passageways that define a desired cooling scheme. The sacrificial core 36, if desired, may also have a plurality of bent portions 47 and 49 along the central portion 41 to form still other film cooling passageways. The number and location of the bent portions 43, 45, 47, 49 are a function of the gas turbine engine component being formed and the need for providing film cooling on the surfaces of the component. If desired, other features may be provided by cutting out portions of the metal sheet forming the sacrificial core 36.

The sacrificial core 36 could embody other refractory metal cores including, but not limited to, two-piece refractory metal cores, balloon or pillow structures (i.e., 3D shapes using refractory metal core as sides), and refractory metal cores having honeycomb shapes.

Figure 3A:
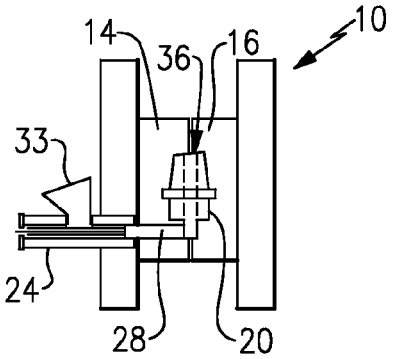
FIG. 3A illustrates a die casting system during casting of a component.
Figure 3B:
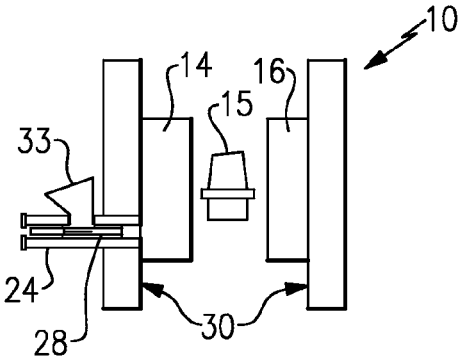
FIG. 3B illustrates a die casting system upon separation from a cast component.

FIGS. 3A and 3B illustrate portions of the die casting system 10 during casting (FIG. 3A) and after die element 14, 16 separation (FIG. 3B). After the molten metal solidifies within the die cavity 20, the die elements 14, 16 are disassembled relative to the component 15 by opening the die 12 via the mechanism 18. A die release agent may be applied to the die elements 14, 16 of the die 12 prior to injection to achieve a simpler release of the component 15 relative to the die 12 post-solidification. The cast component 15 may include an equiaxed structure upon solidification, or could include still other structures. An equiaxed structure is one that includes a randomly oriented grain structure having multiple grains.

Following separation of the die elements 14, 16, the cast component 15 may be de-cored to destructively remove the sacrificial core 36 from the component 15. Exemplary decoring techniques include destructively removing the core by chemical leaching (e.g., alkaline and/or acid leaching). The cast component 15 may then be subjected to finishing operations, including but not limited to, machining, surface treating, coating or any other desirable finishing operation.

A new sacrificial core 36 is used to cast each component 15. Once the sacrificial core 36 is removed, the component 15 is left with an internal geometry within the component, such as a microcircuit cooling scheme for a turbine blade of a gas turbine engine.

FIG. 4 illustrates one example component 15 that may be cast using the example die casting system 10 described above. In this example, the die cast component 15 is a blade for a gas turbine engine, such as a turbine blade for a turbine section of a gas turbine engine. However, this disclosure is not limited to the casting of blades. For example, the example die casting system 10 of this disclosure may be utilized to cast aeronautical components including blades, vanes, combustor panels, blade outer air seals (boas), or any other components that could be subjected to extreme environments, including non-aeronautical components.

The die cast component 15 includes an internal geometry 38 defined within the component 15 (i.e., the component 15 is at least partially hollow). The internal geometry 38 is formed after the sacrificial core 36 is destructively removed from the component 15. In this example, the internal geometry 38 defines a microcircuit cooling scheme for a turbine blade. However, the internal geometry 38 could also define other advanced cooling schemes, trailing edge exits, weight reduction tongues (i.e., voids) or other geometries.

Figure 5:
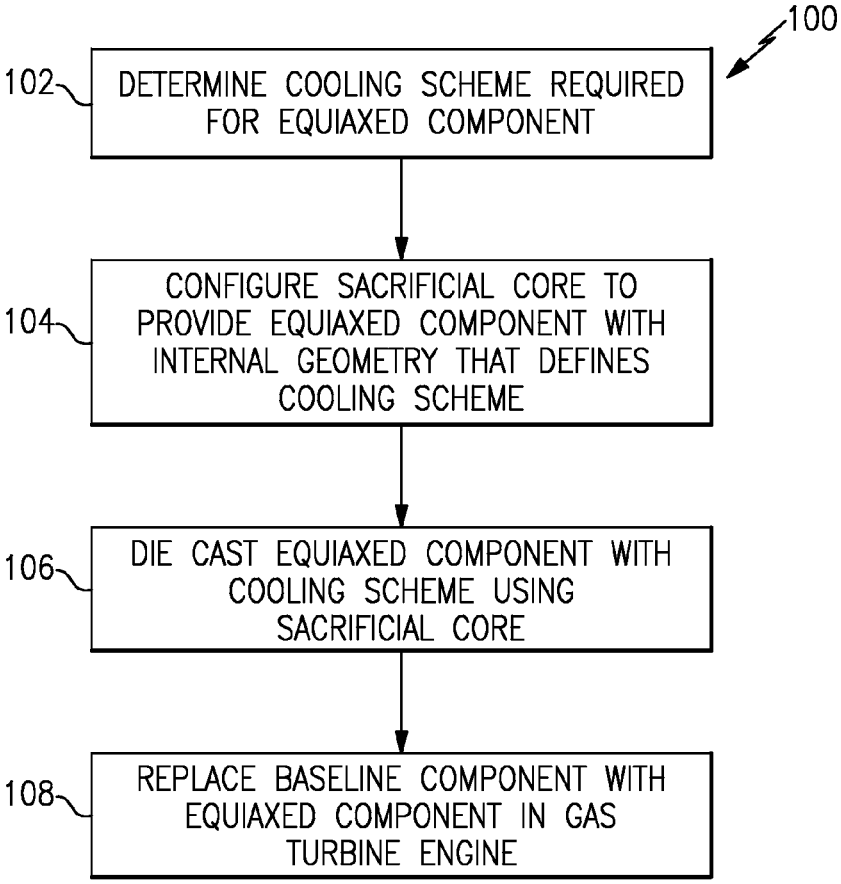
FIG. 5 schematically illustrates an example implementation of a die casting system.

FIG. 5 schematically illustrates an example implementation 100 of the die casting system 10 described above. The exemplary implementation 100 involves replacing a baseline component, such as a single crystal alloy component or a directionally solidified alloy component of a gas turbine engine, with an equiaxed component. Single crystal alloy components are formed as a single crystal of material that includes no grain boundaries in the material, while a directionally solidified alloy component includes grains that are parallel to the major stress axes of the component. Single crystal alloy components and directionally solidified alloy components are generally more expensive to produce compared to equiaxed components.

The baseline component may be replaced with an equiaxed component, or the replacement could involve replacing mating components as well. The example implementation 100 includes determining a cooling scheme required for the equiaxed component to enable the equiaxed component to replace the baseline component, which is depicted at step block 102. At step block 104, a sacrificial core is configured to provide the equiaxed component with an internal geometry that defines the cooling scheme. Next, at step block 106, the equiaxed component is die cast to include the cooling scheme using the sacrificial core.

The baseline component is replaced with the equiaxed component within the gas turbine engine at step block 108. For example, a single crystal alloy turbine blade of the turbine section of the gas turbine engine can be replaced with an equiaxed blade having a desired cooling scheme. In other words, the downselecting of the equiaxed component in place of the baseline component is made possible for certain parts due to the ability to die cast metallic alloys with advanced cooling schemes. Therefore, the equiaxed component can survive at temperatures that traditionally only advanced alloys have survived at.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A die casting system, comprising:

a die comprised of a plurality of die components that define a die cavity;

a sacrificial core assembled to said die and received within said die cavity, said sacrificial core made of a metallic material;

a shot tube in fluid communication with said die cavity; and a shot tube plunger moveable within said shot tube to communicate a molten metal into said die cavity.

2. The die casting system as recited in claim 1, wherein said sacrificial core includes a refractory metal core.

3. The die casting system as recited in claim 2, wherein said refractory metal core includes a protective coating.

4. The die casting system as recited in claim 2, wherein said refractory metal core includes a leading edge portion, a trailing edge portion and a central portion extending between said leading edge portion and said trailing edge portion.

5. The die casting system as recited in claim 4, wherein said leading edge portion includes a plurality of bent portions.

6. The die casting system as recited in claim 4, wherein said central portion includes a plurality of bent portions.

7. The die casting system as recited in claim 1, wherein said sacrificial core includes a hybrid core that includes a ceramic mated to a refractory metal core.

8. The die casting system as recited in claim 1, wherein said sacrificial core includes a two-piece refractory metal core.

9. The die casting system as recited in claim 1, comprising a vacuum source that applies a vacuum to at least said die and said shot tube.

10. The die casting system as recited in claim 1, comprising a melting unit that communicates said molten metal to said shot tube.

11. The die casting system as recited in claim 10, wherein said die, said shot tube and said melting unit are disposed within a vacuum chamber to provide a vacuum die casting system.

12. The die casting system as recited in claim 1, wherein said molten metal includes a high melting temperature material having a melting temperature of at least 1500° F. (815° C.).

13. The die casting system as recited in claim 1, wherein a perimeter portion of said sacrificial core is captured within a compartment of said die.

14. The die casting system as recited in claim 13, wherein said perimeter portion of said sacrificial core falls outside of a component cast inside said die cavity.

15. The die casting system as recited in claim 1, wherein said sacrificial core includes a refractory metal core including a protective coating.

16. The die casting system as recited in claim 15, wherein said refractory metal core is made of at least one of Mo, Nb, Ta, and W.

17. The die casting system as recited in claim 15, wherein said protective coating includes at least one of silica, alumina, zirconia, chromia, mullite, and hafnia.

18. The die casting system as recited in claim 15, wherein said refractory metal core includes a honeycomb shape.

19. The die casting system as recited in claim 1, wherein said sacrificial core is a refractory metal core made of at least one of Nb, Ta, and W.

20. The die casting system as recited in claim 1, wherein one or more portions of said sacrificial core are captured and retained in position by a surface of said die.

21. The die casting system as recited in claim 1, wherein said sacrificial core is contiguous with each of said plurality of die components.

22. A die casting system, comprising:

a die that establishes a die cavity;

a sacrificial core including at least one refractory metal core positioned in said die cavity, said sacrificial core assembled to said die;

a shot tube in fluid communication with said die cavity; and a shot tube plunger moveable within said shot tube to communicate a molten metal into said die cavity.

23. A die casting system, comprising:

a die that establishes a die cavity;

a sacrificial core including at least one refractory metal core positioned in said die cavity, said sacrificial core assembled to said die;

a shot tube in fluid communication with said die cavity;

a shot tube plunger moveable within said shot tube; and a molten metal communicable into said die cavity, said molten metal including a high melting temperature material having a melting temperature of at least 1500° F. (815° C.).

* * * * *